United States Patent [19]

Shimabukuro

[11] Patent Number: 4,843,777

[45] Date of Patent: Jul. 4, 1989

[54] WOODEN SYNTHETIC BEAM

[76] Inventor: Yoshinobu Shimabukuro, 33-15, 1-chome, Oknakacho, Shuri, Naha-shi, Okinawa-ken, Japan

[21] Appl. No.: 141,029

[22] Filed: Jan. 5, 1988

[30] Foreign Application Priority Data

Jan. 13, 1987 [JP] Japan ..... 62-4140

[51] Int. Cl.[4] ..... E04C 3/292; E04C 3/14

[52] U.S. Cl. ..... 52/729; 52/731

[58] Field of Search ..... 52/376, 730, 731, 729, 52/690; 244/123, 124

[56] References Cited

U.S. PATENT DOCUMENTS

| | | | |
|---|---|---|---|
| 158,983 | 1/1875 | Sampson | 52/376 |
| 426,558 | 4/1890 | Dithridge | 52/729 |
| 426,560 | 4/1890 | Dithridge | 52/690 |
| 1,360,720 | 11/1920 | Brown | 52/729 |
| 1,377,891 | 5/1921 | Knight | 52/729 |
| 4,074,498 | 2/1978 | Keller | 52/729 |

FOREIGN PATENT DOCUMENTS

| | | | |
|---|---|---|---|
| 1139518 | 1/1983 | Canada | 52/729 |
| 1164627 | 3/1964 | Fed. Rep. of Germany | 52/729 |
| 1467255 | 12/1966 | France | 52/731 |
| 488886 | 5/1970 | Switzerland | 52/729 |
| 107444 | 7/1917 | United Kingdom | 52/727 |
| 120991 | 12/1918 | United Kingdom | 52/731 |

*Primary Examiner*—John E. Murtagh

*Attorney, Agent, or Firm*—Armstrong, Nikaido, Marmelstein, Kubovcik & Murray

[57] ABSTRACT

This wooden synthetic beam comprises an integral connection of a pair of upper and lower wooden flange members and a web member comprising a pair of wooden web plates which are provided between the flange members and inwardly curved so that central portions thereof are adhered to each other. The adhesion of the central portions of the pair of inwardly curved wooden web plates can be achieved by providing a vertical web plate lengthwise in a central portion between the curved web plates to adhere them each other through the vertical web plate or directly adhering the central portions together of the curved webs. In the case where the central portions of the curved webs are directly adhered together without provision of the central vertical web, the lengthwisely curved webs are divided in a suitable spaced relation, and a connecting bolt for reinforcement is provided on the divided portion. For the purpose of reinforcement, vertical web plates can be provided on opposite sides of the curved web plates.

1 Claim, 2 Drawing Sheets

WOODEN SYNTHETIC BEAM

BACKGROUND OF THE INVENTION

1. Field of the Invention

This invention relates to a wooden synthetic beam comprising a combination of wooden elements.

2. Description of the Prior Art

Beams for construction of wooden dwelling houses and beams used for floor material have to be formed from large wood to secure a sufficient strength. However, with recent consumption of wooden resources, rise in prices of wood results, and when large timber is used for beam material, construction cost increases. Therefore, there has been proposed, for example, as shown in Japanese Utility Model Publication No. 16,338/1986, a construction beam in which a pair of upper and lower wooden flange members are connected by a web member comprising a metal side member and a wooden connecting member to constitute a synthetic beam, whereby similar strength may be obtained without use of large timber.

However, the synthetic beam heretofore proposed is complicated in construction, and uses the metal side members. Therefore there poses a problem of higher manufacturing cost. Moreover, the metal plate side members possibly impair the beauty of a wooden dwelling house, and therefore such a beam can be used only for parts that cannot be seen from outside.

SUMMARY OF THE INVENTION

It is an object of this invention to provide an inexpensive wooden synthetic beam which can be used as a construction beam similarly to a conventional wooden beam, as a beam capable of being used in place of floor joists or purlines for floors and ceilings and as a beam for panel core material, which beam is simple in construction, low in cost and has a sufficient strength.

It is a further object of this invention to provide a wooden synthetic beam which uses thin wooden plates such as plywood as web plates to obtain a sufficient buckling strength.

The aforesaid objects may be achieved by the present invention which provides a construction of a wooden synthetic beam comprising an integral connection of a pair of upper and lower wooden flange members and a web member comprising a pair of wooden web plates which are provided between the flange members and inwardly curved so that central portions thereof are adhered to each other.

The wooden synthetic beam of the present invention has the merit in that as a web member, a pair of wooden web plates inwardly curved and having central portions thereof adhered to each other are employed to thereby increase the buckling strength of the web member in a beam section. Accordingly, even if a web formed from a thin plate such as plywood is used, a great load may be supported.

Furthermore, the wooden synthetic beam of this invention has many other merits in that since thin plates may be used, material cost is low, and since working and assembly are easy, the beam can be manufactured at less cost.

BRIEF DESCRIPTION OF THE PREFERRED EMBODIMENTS

Figure 1:
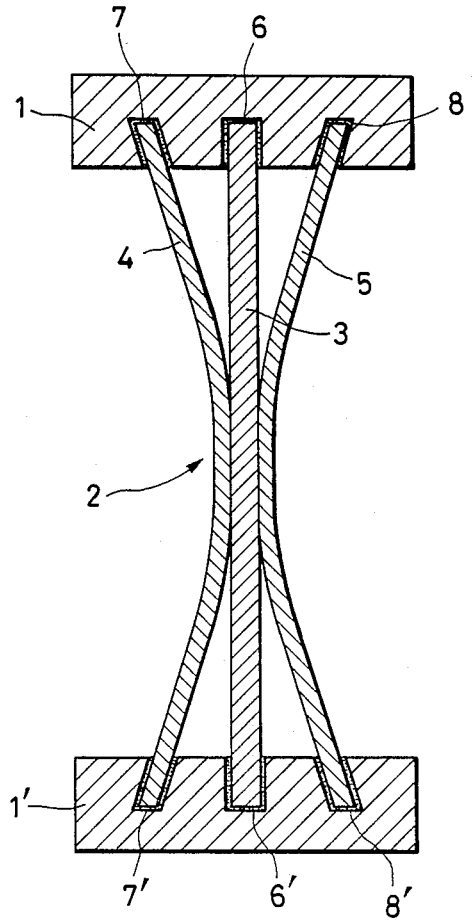
FIGS. 1 to 5 are sectional views of the first to fifth embodiments of a wooden synthetic beam according to this invention.

FIG. 1 shows a first embodiment of a wooden synthetic beam according to the present invention. Numeral 1, 1' designates a pair of upper and lower flange members formed from structural plywood immersed with resins, the flange members being formed with long grooves 6, 6', 7, 7', 8, 8' internally of the opposed flanges into which a web member 2 described later is fitted and bonded. The web member 2 comprises a vertical web plate 3 formed from plywood and positioned in the center, and a pair of curved web plates 4, 5 formed on opposite sides thereof and by each curving thin plywood with respect to the web plate member 3, and central curved portions of the curved web plates 4, 5, respectively, are adhered by adhesives to the vertical web plate 3. Both upper and lower ends of the vertical web plate 3 and the curved web plates 4, 5 on the opposite sides thereof are fitted into said long grooves of the flange members 1, 1', respectively and adhered to and engaged with each other by adhesives, and connected integral with the flange members 1, 1'.

The thus constructed web member increases its buckling strength as compared with a member which comprises a mere verical connection of web plates, obtaining a beam capable of supporting a great load despite the relatively thin plywood. In addition, the beam constructed as described above is made by using plywood, and therefore material cost is low and assembling thereof is easy, thus being able to fabricate the beam at less cost. If the thus structured beams are used for floors and roofs in wooden prefab dwelling houses, floor joists and purlines are not required, and therefore the rigid floors and roofs can be obtained.

Figure 2:
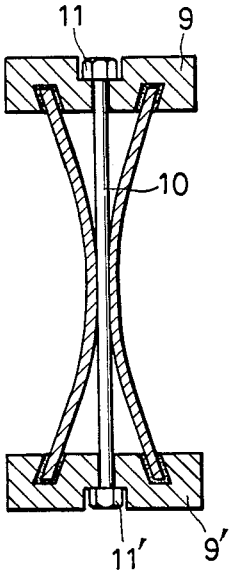

FIG. 2 shows a second embodiment of a wooden synthetic beam according to the present invention. In the synthetic beam of the aforementioned first embodiment, the centrally located vertical web plate 3 is divided lengthwise of the beam in a fixed spaced relation, at which position, a connecting bolt 10 extending through flange members 9, 9' is provided. The bolt 10 is not projected from the top surfaces of the flange members 9, 9' with nut portions on the opposite ends thereof embedded within nut-fitting recesses 11, 11' formed in the top surfaces of the flange members 9, 9'. By the provision of such a bolt, it is possible to obtain a beam in which the flange portions, 9, 9' are firmly connected.

Figure 3:
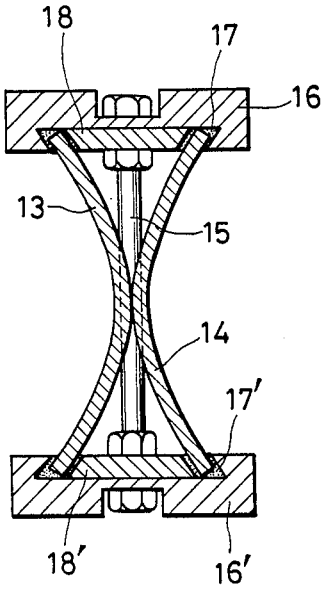

FIG. 3 shows a third embodiment of a wooden synthetic beam according to the present invention. The beam of this embodiment has a web member constituted by curved web plates 13, 14 and a connecting bolt 15 in a spaced apart relation, omitting the central web plate used in the second embodiment. In this embodiment, for facilitating working and assembly, dovetail grooves 17, 17' of width where ends of the curved web plates 13, 14 are positioned are formed internally of the opposed flange members 16, 16', and spacers 18, 18' having a trapezoid section of width corresponding to the internal spacing between the upper and lower ends of the curved web plates 13, 14 are secured to the central portions of the dovetail grooves 17, 17', respectively. The side walls of the dovetail grooves 17, 17' and the side walls of the trapezoid spacers constitute a fitting groove in which the ends of the curved web plates 13, 14 are fitted and bonded. The curved web plates 13 and 14 have their central curved portions contacted each other so that said curved portions are integrally adhered to each other by means of adhesives. The curved web plates 13 and 14 are divided lengthwise in a suitable spaced relation, and a connecting member 15 is provided in a manner similar to the aforementioned embodiment.

Figure 4:
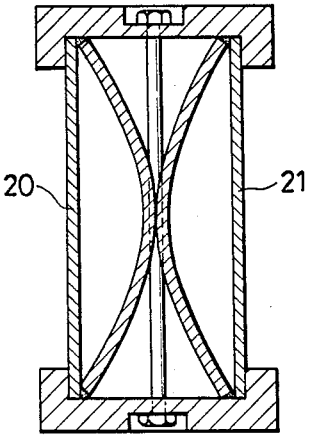

FIG. 4 shows a fourth embodiment, in which a further pair of vertical web plates 20, 21 are provided externally of the curved web plates in the third embodiment. With this arrangement, a beam having a greater strength may be obtained. The vertical web plates 20, 21 are formed from thicker plates depending on the using purpose whereby they can be applied to a beam for a construction which support a greater load.

Figure 5:
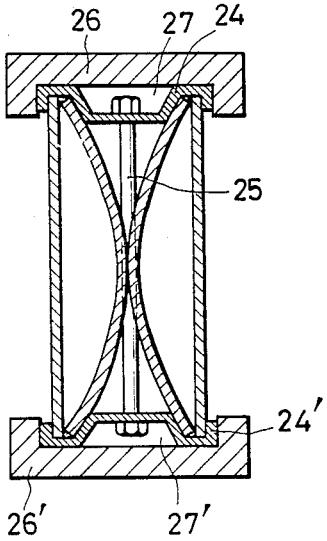

FIG. 5 shows a fifth embodimnt, which improves over the connecting portion of the web member to the flange members in the fourth embodiment, thus facilitating assembly. In this embodiment, upper and lower ends of a web member are fitted into a fitting 24, 24' and fastened by a connecting bolt 25 in a spaced relation, the fittings 24, 24' being press-fitted through adhesives or the like to wide slots 27, 27' formed in flange members 26, 26' whereby the web member and the flange members are connected integrally.

While various embodiments of the wooden synthetic beams according to the present invention have been shown, the present invention is not limited to those shown but these embodiments can be further changed in design to provide various other forms.

It is further noted that the flange members and web plates are noted limited in material to plywood but natural wood can be used.

What is claimed is:

1. A wooden synthetic beam comprising an integral connection of upper and lower wooden flange members and a web member comprising a pair of wooden web plates which are affixed, at their opposite ends, respectively, at spaced positions relative to each other, to said upper and lower wooden flange members and are accurately curved inwardly relative to each other with the central portions of said arcs of said arcuate plates adhered to each other, said pair of inwardly curved wooden plates being divided lengthwise in a suitable spaced relation, and a connecting bolt which extends through the pair of upper and lower wooden flange members being provided at said divided portion.

* * * * *